US010144105B1

(12) United States Patent
Moyer

(10) Patent No.: US 10,144,105 B1
(45) Date of Patent: Dec. 4, 2018

(54) HANDLE EXTENSION FOR BELT SANDER

(71) Applicant: Anthony Moyer, Elizabethtown, PA (US)

(72) Inventor: Anthony Moyer, Elizabethtown, PA (US)

( * ) Notice: Subject to any disclaimer, the term of this patent is extended or adjusted under 35 U.S.C. 154(b) by 3 days.

(21) Appl. No.: 15/666,250

(22) Filed: Aug. 1, 2017

(51) Int. Cl.
*B24B 21/04* (2006.01)
*B24B 21/18* (2006.01)

(52) U.S. Cl.
CPC ..... *B24B 21/18* (2013.01); *B24B 21/04* (2013.01)

(58) Field of Classification Search
CPC ..... B24B 21/04; B24B 21/18; Y10T 16/469; Y10T 16/4713; Y10T 16/4719; A47J 45/07; A47J 45/10; B25F 5/024; B25F 5/026; B25G 1/04; B26B 21/523
USPC ..... 451/355, 354, 296; 16/422, 426, 427
See application file for complete search history.

(56) References Cited

U.S. PATENT DOCUMENTS 1,147,594 A * 7/1915 Ball ..... A61C 17/005 433/125
1,635,119 A * 7/1927 Dziuba ..... A47J 45/10 220/759
2,483,720 A * 10/1949 Asbury ..... B24B 23/005 451/311
2,819,565 A * 1/1958 Werth ..... B24B 23/06 451/303
3,643,385 A * 2/1972 Mikiya ..... B24B 23/06 451/355
3,983,664 A * 10/1976 Martin ..... B24B 23/06 451/355
6,142,693 A * 11/2000 Bruggeman ..... A47L 1/15 15/147.2
6,584,648 B2 * 7/2003 Ortega ..... B25G 1/00 137/378
6,588,065 B1 * 7/2003 Tucker, III ..... B25G 1/04 16/426
6,651,346 B1 * 11/2003 Sturgis ..... B25G 3/36 30/337
7,635,293 B2 * 12/2009 Sun ..... B24B 55/102 451/354
7,997,961 B1 * 8/2011 De La Rosa ..... B24B 23/005 451/354
8,573,438 B1 * 11/2013 Cheng ..... A47J 45/071 16/422
2002/0088088 A1 * 7/2002 Lin ..... B25F 1/02 16/422
2003/0221292 A1 * 12/2003 Pozgay ..... B25F 5/02 16/422
2005/0125955 A1 * 6/2005 Lewis ..... A45F 5/102 16/426
2006/0042047 A1 * 3/2006 Decker ..... A47L 9/0036 16/430

(Continued)

*Primary Examiner* — George Nguyen
(74) *Attorney, Agent, or Firm* — Andrew Morabito

(57) ABSTRACT

A handle extension for a belt sander comprising a hollow member having a front side, a rear side, a first side, a second side, and a third side, wherein the front side, rear side, and first side have a cutout in a predetermined location and size and the third side has an opening in a predetermined location and a predetermined size, a handle of a predetermined length and sized to be received by the opening on the third side of the hollow attachment member, and a securing mechanism attached to at least the first side and the second side of the hollow member.

20 Claims, 5 Drawing Sheets

(56) References Cited

U.S. PATENT DOCUMENTS

2013/0098211 A1* 4/2013 Sampson, Sr. ..... B25G 1/005
81/177.2

* cited by examiner

HANDLE EXTENSION FOR BELT SANDER

BACKGROUND OF THE INVENTION

The present invention relates to belt sanders, and more particularly to a handle extension for a belt sander.

A belt sander is a sander used in shaping and finishing wood and other materials. It consists of an electric motor that turns a pair of drums on which a continuous loop of sandpaper is mounted. Belt sanders may be handheld and moved over the material, or stationary (fixed), where the material is moved to the sanding belt. Stationary belt sanders are sometimes mounted on a work bench, in which case they are called bench sanders. Stationary belt sanders are often combined with a disc sander.

Handheld belt sanders are used to sand rough edges on flooring products such as plywood strand boards or other materials. For flooring operations, the workman must operate on hands and knees in close proximity to the dust created by the sanding operation. Working in these conditions can cause respiratory problems as well as pain and achiness in the workman's back, knees, and arms.

It is desired to have an attachment for the belt sanders that allows the operator to be in the standing or crouched position when using the belt sander so they are in a more ergonomic position and are away from the dust that is created from the belt sander. Therefore, a handle extension for the belt sander assists in solving these issues.

SUMMARY

Accordingly, it is an objective of the present invention to convert a conventional hand-held belt sander to a walk-behind unit by the addition of a unique extension handle. It is a further objective of the invention to demonstrate a conversion system wherein an extended handle may be easily attached to or detached from a belt sander. It is an objective of the invention to set forth a handle that is attached to the belt sander and the belt sander's trigger is still accessible. It is still further object of the invention to show an extension handle assembly which may be economically mass-produced for widespread commercial appeal. These and other objects and advantages of the present invention will be apparent to those of skill in the art from the description which follows.

Accordingly the present invention, may be comprised of a hollow member having a first side, a second side, a third side, a fourth side, and a fifth side, wherein the first side, second side, and third side have a predetermined cutout and the fifth side has a predetermined opening, a handle having a first end and a second end of a predetermined length and diameter, wherein the first end of the handle is sized to be received by the opening on the fifth side of the hollow attachment member, and a securing mechanism attached to at least the third side and fourth side of the hollow member, wherein the securing mechanism is removably attachable.

The present invention may further comprise a hollow member having a first side, a second side, a third side, a fourth side, and a fifth side, wherein a first slot is formed on the first side, a second slot is formed on the second side, and a third slot is formed on the third side and the fifth side has an opening, a handle having a first end and a second end of a predetermined length, wherein the first end of the handle is sized to be received by the opening on the fifth side of the hollow attachment member, and a securing mechanism attached to the hollow member.

The present invention may also further comprise a hollow member having a first side, a second side, a third side, a fourth side, and a fifth side, wherein a first slot is formed on the first side, a second slot is formed on the second side, and a third slot is formed on the third side and the fifth side has an opening, a handle comprising, a first portion, having a first end and second end, wherein the first end is sized to fit within the opening of the hollow member, a rotatable joint attached to the second end of the first portion, a second portion having a first end and a second end, and the first end is attached to the rotatable joint, and a grip secured to the second end of the second portion; and a securing mechanism attached to the hollow member.

DETAILED DESCRIPTION OF THE INVENTION

Figure 1:
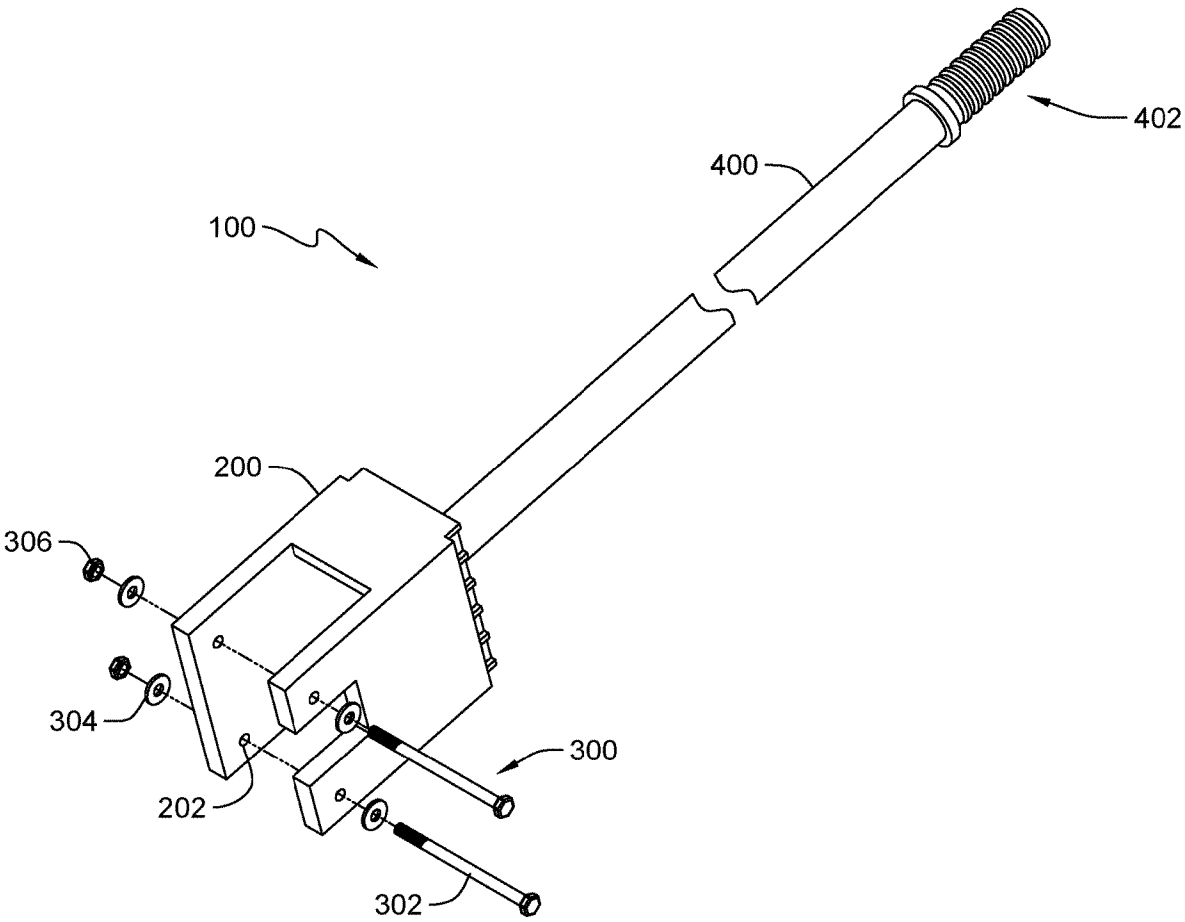
FIG. 1 depicts an isometric view of a handle extension, in accordance with one embodiment of the present invention.

The present invention provides a device that allows a handheld belt sander (hereinafter "belt sander") or floor sander to be retrofitted to work as a floor belt sander without the operator needing to be hunched over and on their knees to properly sand the floor or surface that is out of arms reach. The operator can operate the belt sander in a more ergonomic position such as standing or crouched. The device therefore, allows the operator to use the belt sander for a longer period of time than without, and also assist in alleviating knee, back, and arm pain. In addition, the device allows the operator to operate the belt sander from a distance that will alleviate irritation or a negative reaction to the dust produced while operating the belt sander due to the increased distance between the portion of the belt sander producing the dust and the operator's face.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

FIG. 1 depicts an isometric view of a handle extension 100, in accordance with one embodiment of the present invention. The handle extension 100 is comprised of a handle attachment 200, a securing means 300, and a handle 400. In additional embodiments, additional elements may be incorporated into the design of the handle extension 100. The handle extension 100 is designed to allow an operator to be able to control the belt sander on a surface that is farther than arms reach away in a comfortable and ergonomic position.

The handle attachment 200 is designed to attach to a handle of a belt sander so that the operator can have access to the trigger(s) of the belt sander. In the depicted embodiment, the handle attachment 200 is a hollow structure designed to attach to the handle of a belt sander. In the depicted embodiment, the handle attachment 200 is shown with the securing means 300, which is shown as a set of bolts 302 and washers 304, the nuts 306. In the depicted embodiment, the securing means 300 is inserted through openings 202 in the handle attachment 200 to secure the handle attachment to the belt sander.

The securing mechanism 300 is designed to secure the handle attachment 200 to the belt sander. In the depicted embodiment, the securing mechanism 300 is comprised of bolts 302, washers 304, and nuts 306. The bolts 302 are inserted into the openings 202 and the nuts 204 are tightened and the handle attachment 200 is secured in place around the handle of the belt sander. In additional embodiments, the securing mechanism 200 may be, but not limited to adjustable straps, cinch straps, screws, or the like that would be inserted through the openings 202 and secure the handle extension 100 to the belt sander. In additional embodiments, latches, clamps, pressure clamps, bolt clamps may be integrated into the handle attachment 200 and secure the handle attachment 200 to the belt sander. These latches, clamps, or the like may be integrated into the handle attachment 200 or may be affixed to the handle attachment 200.

The handle 400 is secured to the handle attachment 200 and allow the operator to use the belt sander without the need to be on their knees or in an uncomfortable or undesirable position. In the depicted embodiment, the handle 400 is a rod with a grip 402 attached to one end. The handle 400 is a predetermined length and diameter to provide adequate positioning of the user and strength to properly direct the belt sander. The handle 400 may be made from, but not limited to polyethylene, polyethylene terephthalate, high-density polyethylene, polypropylene, polystyrene, polyvinyl chloride, polyurethane, poly carbonate, polybutylene terephthalate, acrylonitrile styrene acrylate, acrylics, aluminum, steel, cooper, various other metals, a combination of plastics and metals, or the like. In some embodiments, the handle 400 is extendable and retractable for adjustability to the length. In additional embodiments, the handle 400 is comprised of several portions that are detachable to allow for customization of the length of the handle 400. The portions may attach to one another by various types of locks such as bolt style locks, pressure locks, snap locks, and the like. In some embodiments, the handle 400 and the handle attachment 200 are a unitary design.

In some embodiments, the handle 400 has a hinge or joint that allows the angle of the handle 400 to be adjustable. In additional embodiments, a ball joint may be used in the handle 400. The hinge or joint of the handle 400 may have a locking mechanism to secure the handle in place.

Figure 2:
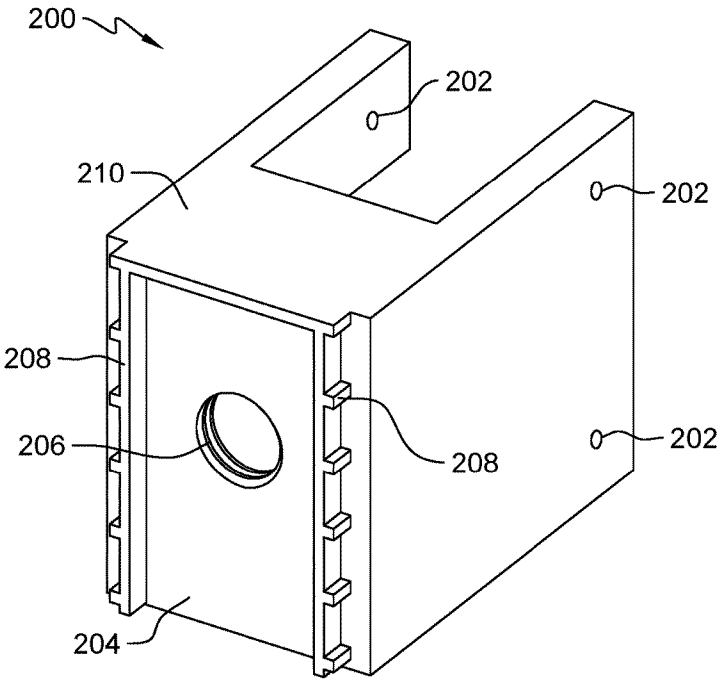
FIG. 2 depicts an isometric view of a front view of the handle attachment, in accordance with one embodiment of the present invention.

FIG. 2 depicts an isometric view of a front view of the handle attachment 200, in accordance with one embodiment of the present invention. In the depicted embodiments, the handle attachment 200 has a hollow rectangular shape. The handle attachment 200 has a top side 204 with a handle opening 206 to receive the handle 400. The handle opening 206 is designed to secure the handle 400 to the handle attachment. This can be done with a screw lock, pressure lock, or other types or releasable locking mechanism. The handle opening 206 is sized to receive the handle 400. The supports 208 are integrated into the handle attachment 200 to provide additional structural support so the weight of the belt sander, and the forces exerted on the handle attachment 200 do not cause excess damage. In additional embodiments, more than one handle opening 206 may be present on the top surface 204 to allow for the user to local an ideal and ergonomic position of the handle 400 while using the sander. In additional embodiments, the handle opening 206 may be perpendicular to the top surface 204 or may be at an offset angle to further improve the ergonomics of the handle extension 100.

The plurality of openings 202 allow the securing means 300 to secure the handle attachment 200 to the handle of the belt sander. In the depicted embodiment, these openings 202 are circular. In various embodiments, these openings 202 may be slots or have various shapes to allow for adjustability of the final placement of the handle extension 100 once secured to the belt sander. In the desired embodiment, the plurality of openings 202 are positioned so that once the handle attachment 200 is placed over the handle of the belt sander, the openings 202 are positioned to allow for a substantially secure fit to the belt sander. This may require more or less openings 202 depending on the belt sander design. In some embodiments, the openings 202 are not needed and the securing means 300 is integrated into the handle attachment 200.

Figure 3:
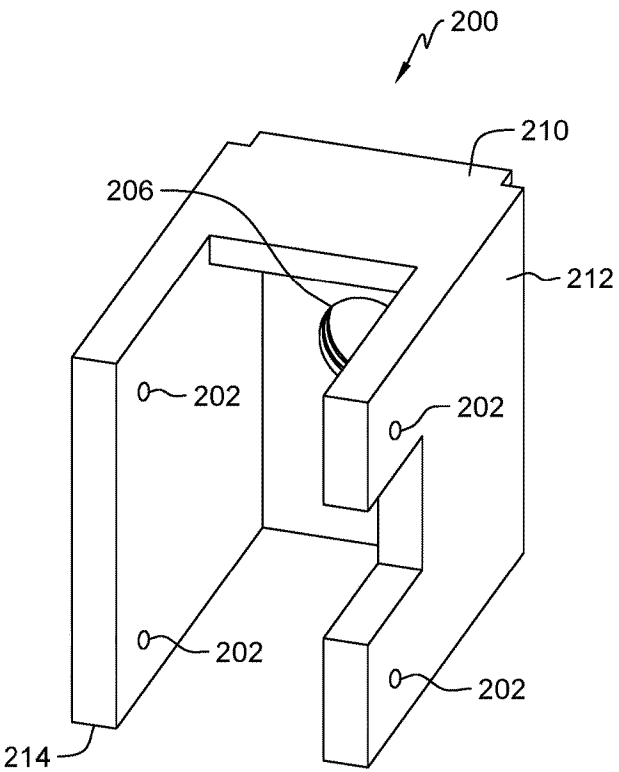
FIG. 3 depicts an isometric view of a rear view of the handle attachment, in accordance with one embodiment of the present invention.

FIG. 3 depicts an isometric view of a rear view of the handle attachment 200, in accordance with one embodiment of the present invention. The depicted embodiment shows the hollow design of the handle attachment 200, this hollow design allows for the handle of the sander to easily be inserted into the handle attachment 200. In the depicted embodiment, a cutout is shown on surface 210 surface 212, and 214. The cutouts on surface 210 and 214 are sized and position to receive a substantial portion of the handle of the sander to establish a secure fitment of the handle attachment 200 around the handle of the sander. In the depicted embodiment, the cutout on surface 214 is large than the cutout on surface 210. This is to allow the handle attachment 200 to be positioned in a way that the handle 400 is directed in an ergonomic direction for the user, so the user is not hunched over.

Figure 4:
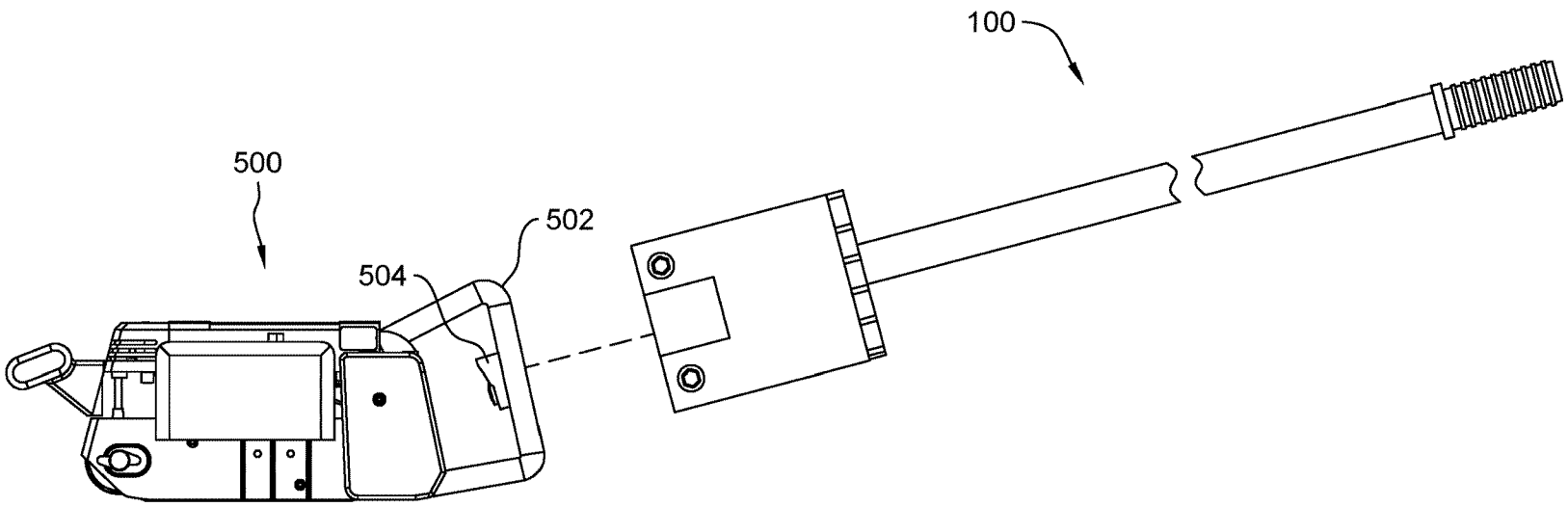
FIG. 4 depicts a side view of the handle extension and a belt sander, in accordance with one embodiment of the present invention.

The cutout on surface 212 is used to allow the user access to a trigger that is typically installed on belt sanders to allow the user when operating the belt sander to be able to quickly and easily turn on or off the belt sander. The cutout on surface 212 is sized and positioned to allow the user access to this power switch based on the type of belt sander. This cutout allows the user to easily turn on and off the belt sander without the need to remove the entire handle extension 100 each time. This cutout may be located on surface 212 or other surfaces based on the type and style of belt sander. This cutout may also be on be on multiple surfaces of the handle attachment 200 to allow for multiple access points for the user to the trigger FIG. 4 depicts a side view of the handle extension 100 and a belt sander 500, in accordance with one embodiment of the present invention. In the depicted embodiment, belt sander 500 has a handle 502 with a trigger 504 positioned on the handle 502. The handle extension 100 is shown prior to installation.

Figure 5:
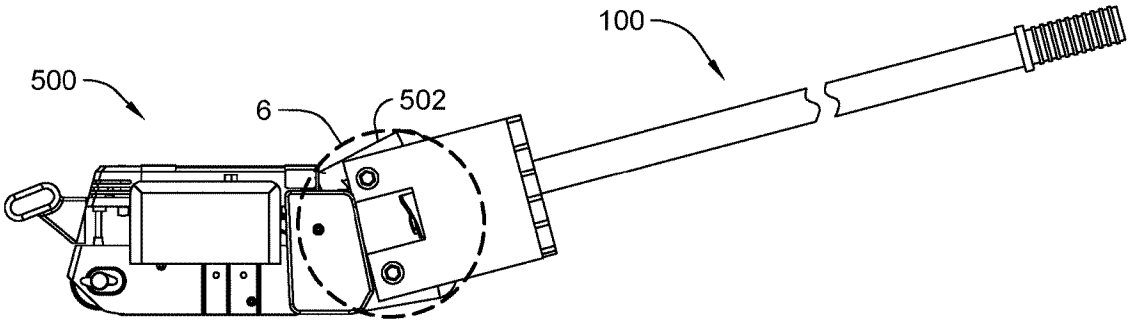
FIG. 5 depicts a side view of the handle extension attached to the belt sander, in accordance with one embodiment of the present invention.

FIG. 5 depicts a side view of the handle extension 100 attached to the belt sander 500, in accordance with one embodiment of the present invention. In the depicted embodiment, it is shown where the handle attachment 200 covers a large portion of handle 502. The handle extension 100 is secured to the belt sander 500 so that the user can easily operate the belt sander 500 without the need to be on their hands and knees.

Figure 6:
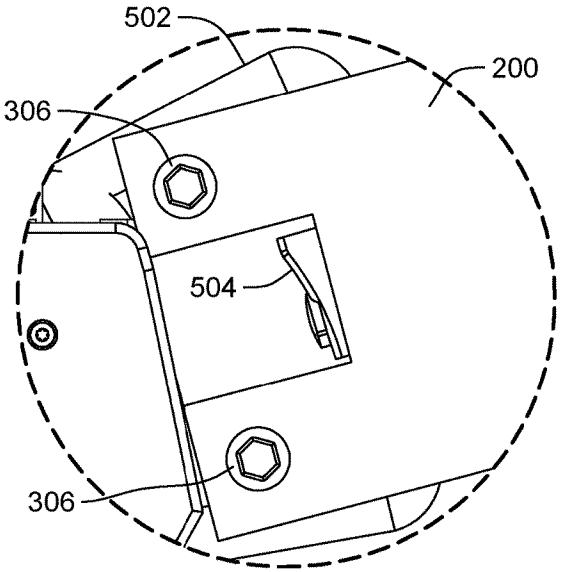
FIG. 6 depicts a detailed view of the handle extension attached to the belt sander, in accordance with one embodiment of the present invention.

FIG. 6 depicts a detailed view of the handle extension 100 attached to the belt sander 500, in accordance with one embodiment of the present invention. In the depicted embodiments, the trigger 504 is exposed by the cutout in the handle attachment 200. This allows the operator to easily access the trigger 504. The securing means 300 is shown in the locked position so that the bolts 302 are positioned to keep the handle attachment 200 from moving or adjusting. In various embodiments, the securing means 300 may have more or less mechanism to secure the handle extension 100 in place dependent upon the size and shape of the belt sander 500. In some embodiments, the securing means 300 attaches to the body of the belt sander 500 because no handle 502 is present. In various embodiments, and with other belt sanders 500 the trigger 504 may be located in various locations and positions on the handle 502.

Figure 7:
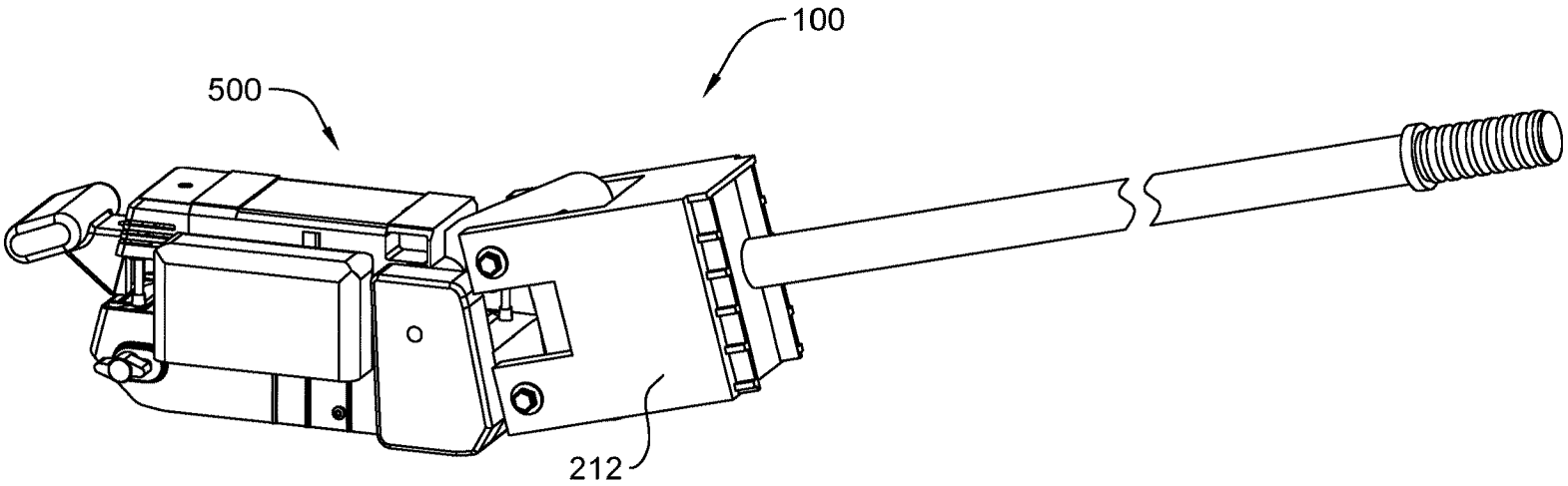
FIG. 7 depicts an isometric view of the handle extension attached to the belt sander, in accordance with one embodiment of the present invention.

FIG. 7 depicts an isometric view of the handle extension 100 attached to the belt sander 500, in accordance with one embodiment of the present invention. In the present embodiment, it is shown that the cutout on surface 212 allows access to a large portion of the handle area. This assists with allowing the user access to this area of quick adjustments need to be made or if there is more than one trigger, while also providing a small enough opening to keep any saw dust or debris that is creating while sanding to allow minimal saw dust into this area that could potentially damage the belt sander 500.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A handle extension for a belt sander comprising:

a hollow member having a first side, a second side, a third side, a fourth side, and a fifth side, wherein the first side, second side, and third side have a predetermined cutout and the fifth side has a predetermined opening;

a handle having a first end and a second end of a predetermined length and diameter, wherein the first end of the handle is sized to be received by the opening on the fifth side of the hollow attachment member; and a securing mechanism attached to at least the third side and fourth side of the hollow member, wherein the securing mechanism is removably attachable.

2. The handle extension for a belt sander of claim 1, further comprising a grip attached to the second end of the handle.

3. The handle extension for a belt sander of claim 1, wherein the opening on the fifth side of the hollow member and the first end of the handle are threaded.

4. The handle extension for a belt sander of claim 1, wherein the hollow member has a plurality of aligned openings on the third side and fourth side, wherein the securing mechanism attaches to the hollow member through this plurality of openings.

5. The handle extension for a belt sander of claim 1, wherein the hollow member is comprised of a polyethylene material.

6. The handle extension for a belt sander of claim 1, wherein the opening on the fifth side of the hollow member is substantially parallel to the first side and the second side of the hollow member.

7. The handle extension for a belt sander of claim 1, wherein the opening on the fifth side of the hollow member is angled relative to the first side and the second side of the hollow member.

8. The handle extension for a belt sander of claim 1, wherein the securing mechanism is a plurality of bolts which are inserted through the plurality of aligned openings located on the first side and the second side of the hollow member.

9. The handle extension for a belt sander of claim 1, wherein the cutout on the first side and the second side are substantially similar.

10. The handle extension for a belt sander of claim 1, wherein the fourth side has a cutout which is aligned with the cutout on the third side.

11. A handle extension for a belt sander comprising:

a hollow member having a first side, a second side, a third side, a fourth side, and a fifth side, wherein a first slot is formed on the first side, a second slot is formed on the second side, and a third slot is formed on the third side and the fifth side has an opening;

a handle having a first end and a second end of a predetermined length, wherein the first end of the handle is sized to be received by the opening on the fifth side of the hollow attachment member; and a securing mechanism attached to the hollow member.

12. The handle extension for a belt sander of claim 11, further comprising a grip attached to the second end of the handle.

13. The handle extension for a belt sander of claim 11, wherein a plurality of openings are positioned on the first side and the second side and the securing mechanism is inserted through the plurality of openings to secure the handle extension to a belt sander handle.

14. The handle extension for a belt sander of claim 11, wherein the opening is substantially perpendicular to the fifth side surface.

15. The handle extension for a belt sander of claim 11, wherein the handle and the hollow member are a unitary element.

16. The handle extension for a belt sander of claim 11, further comprising a rotatable joint integrated within the handle, wherein the angle of the handle may be adjusted.

17. The handle extension for a belt sander of claim 16, wherein the rotatable joint has a locking mechanism integrated within the joint.

18. The handle extension for a belt sander of claim 11, wherein the securing mechanism is a plurality of bolts which are inserted through the plurality of openings.

19. The handle extension for a belt sander of claim 11, wherein the slot on the first side and the second side are substantially similar in size.

20. A handle extension for a belt sander comprising:

a hollow member having a first side, a second side, a third side, a fourth side, and a fifth side, wherein a first slot is formed on the first side, a second slot is formed on the second side, and a third slot is formed on the third side and the fifth side has an opening;

a handle comprising;

a first portion, having a first end and second end, wherein the first end is sized to fit within the opening of the hollow member, a rotatable joint attached to the second end of the first portion, a second portion having a first end and a second end, and the first end is attached to the rotatable joint, and a grip secured to the second end of the second portion; and a securing mechanism attached to the hollow member.

* * * * *